US005706039A

United States Patent [19]

Chamberlain et al.

[11] Patent Number: 5,706,039

[45] Date of Patent: Jan. 6, 1998

[54] NOZZLE PLATE FOR INK JET PRINTER

[75] Inventors: Colin Edward Chamberlain, Hertfordshire; Ammar Lecheheb, Suffolk; Danny Charles Palmer; Jerzy Zaba, both of Cambridge, all of United Kingdom

[73] Assignee: Domino Printing Science PLC, Cambridge, United Kingdom

[21] Appl. No.: 481,362

[22] PCT Filed: Jan. 26, 1994

[86] PCT No.: PCT/GB94/00143

§ 371 Date: Jul. 7, 1995

§ 102(e) Date: Jul. 7, 1995

[87] PCT Pub. No.: WO94/16900

PCT Pub. Date: Aug. 4, 1994

[30] Foreign Application Priority Data

Jan. 27, 1993 [GB] United Kingdom ..... 9301602

[51] Int. Cl.[6] ..... B41J 2/14; B41J 2/165

[52] U.S. Cl. ..... 347/47; 347/28

[58] Field of Search ..... 347/28, 47, 44

[56] References Cited

U.S. PATENT DOCUMENTS

| | | | |
|---|---|---|---|
| 3,974,508 | 8/1976 | Blumenthal | 346/140 |
| 4,007,465 | 2/1977 | Chaudhary | 346/140 |
| 4,710,073 | 12/1987 | Peterson | 408/181 |
| 4,953,612 | 9/1990 | Sare et al. | 264/102 |
| 4,987,429 | 1/1991 | Finley et al. | 346/157 |
| 5,229,785 | 7/1993 | Leban | 346/1.1 |
| 5,389,961 | 2/1995 | Takagi | 347/29 |
| 5,495,272 | 2/1996 | Yamaguchi | 347/28 |
| 5,574,486 | 11/1996 | Whitlow et al. | 347/45 |

FOREIGN PATENT DOCUMENTS

| | | | |
|---|---|---|---|
| 62-90252 | 4/1987 | Japan | B41J 3/04 |

OTHER PUBLICATIONS

Method for Washing Ink Jet Printer, vol. 11, No. 296 (M-627) (2743) Sep. 25, 1987.

Ink Jet Recording Appartus vol. 12, No. 374, (M749) (3221) Oct. 6, 1988.

Ink Jet Recorder vol. 5 No. 101 (M-76) (773) Jun. 30, 1981.

*Primary Examiner*—Safet Metjahic

*Assistant Examiner*—Christopher E. Mahoney

*Attorney, Agent, or Firm*—Laff, Whitesel, Conte & Saret, Ltd.

[57] ABSTRACT

A continuous ink jet printer has a nozzle plate 1 which includes an orifice 3 for emitting a stream of ink. A counterbore 4 surrounds the orifice. A passage 5, 6 is provided which lies substantially in the plane of the plate and intersects the counterbore, and through which a flow of cleaning agent may be supplied to the counterbore, in order to flush ink from the surrounds of the orifice.

14 Claims, 2 Drawing Sheets

NOZZLE PLATE FOR INK JET PRINTER

The present invention relates to an ink jet printer and, more particularly, a nozzle plate for an ink jet printer.

Ink jet printers are well known and different types (both continuous and drop-on-demand) each include a nozzle plate through or in which single or plural nozzles are formed or mounted for emission of ink. The nozzles may be formed as separate nozzle members, for example in the form of a jewel with an orifice formed therein and mounted at an aperture in the plate, or else may be formed simply as a orifice(s) in the plate. The plate forms a front or closure member on a printhead, behind which lies an ink reservoir or an ink feed channel.

One particular problem which occurs on shutdown of an ink jet printer is in connection with ink residues which may be left around the nozzle. These may agglomerate to cause a build-up of dried ink which may distort the jet emitted from the nozzle. It is known to wash the area of the nozzle by means of a flow of cleaning fluid, which, in the case of a solvent based ink, may be neat solvent fluid. However, this generally involves considerable wastage of solvent and is often environmentally unacceptable.

Accordingly, it is an object of this invention to provide a nozzle plate inherently adapted to allow nozzle washing without such difficulties and, moreover, one in which a cleaning fluid can be accurately directed to the area in which agglomerations might otherwise be built up.

According to the present invention there is provided a nozzle plate for an ink jet printer, the nozzle plate including an orifice for emitting a stream of ink; a counterbore surrounding the orifice; and a passage substantially in the plane of the plate and intersecting the counterbore, through which passage a flow of cleaning agent may be supplied to the counterbore, in order to flush ink from the surrounds of the orifice.

Preferably, the passage comprises a supply duct and a return duct through which solvent can be withdrawn from the counterbore area by means of a vacuum pump attached thereto. By providing a vacuum pump or the like solvent wastage can be avoided whilst ensuring satisfactory cleaning of the area around the orifice when printing is stopped.

The ducts may be formed by pairs of channels (preferably V-shaped) formed in opposed halves of a composite, two-layer, plate, but, preferably, are formed by wire electro-discharge machining.

Two examples of nozzle plates according to the invention, will now be described with reference to the accompanying drawings, in which.

Figure 1:
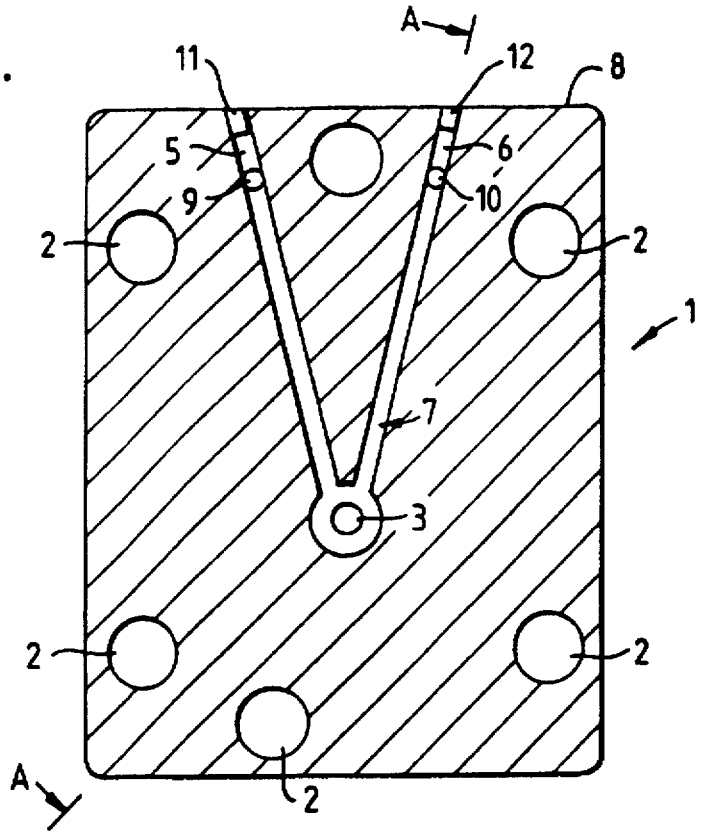
FIG. 1 is a planar sectional view (on B—B of FIG. 2) through a first plate.
Figure 2:
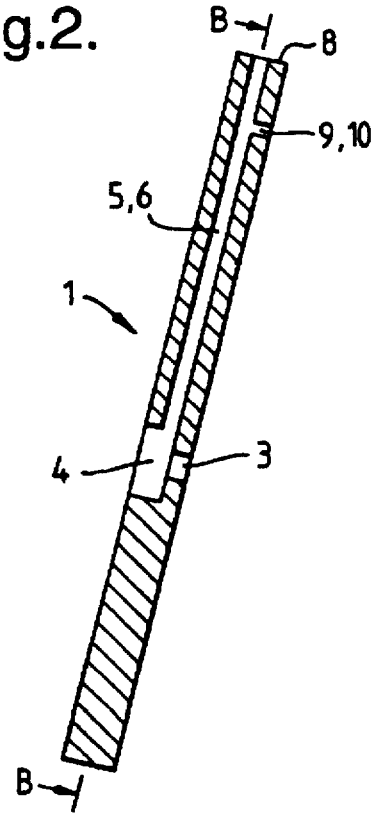
FIG. 2 is a cross-sectional view (on A—A of FIG. 1) of the same plate.

The nozzle plate 1 of FIGS. 1 & 2 comprises a thin stainless steel plate having a number of fixing holes 2 and a central, circular, single ink jet nozzle formed by an orifice 3. Bolts (not shown) are used to bolt the plate to the front of a printhead (not shown).

Around the ink jet nozzle orifice 3, on the outer surface of the plate, a counterbore 4 is formed of larger diameter than the orifice 3.

In the central plane of the plate 1 there are formed (by electro-discharge forming in this example) a pair of passageways 5,6 which form a substantially V-shaped passage 7 for ink solvent or other suitable cleaning agent fluid. Each of the passages 5,6 extends from an edge 8 of the nozzle plate to the counterbore 4 and intersects with it. A cleaning fluid inlet 9 and outlet 10 are formed to and from the respective passages 5,6, through the plate 1 as shown. The inlet and outlet extend from the opposite side of the plate to that from which the nozzle emits the stream of ink in use, so that they can be connected to suitable supply and return passages (not shown) in the printhead.

To complete the formation of the plate a closure plug 11,12 is inserted as a sealing fit into the open end of each passage 5,6.

In use solvent or other fluid cleaning agent can be supplied through one passage (say 5) to the counterbore 4, at which point it swirls around the counterbore adjacent to the edge of the nozzle orifice 3, in order to clean the orifice after printing is halted, before being removed through the other passage (say 6). Fluid tension may serve to retain the cleaning fluid in the counterbore vefore it leaves through the passage 6 carrying with it dried ink particles removed from the surfaces around the orifice.

Figure 3:
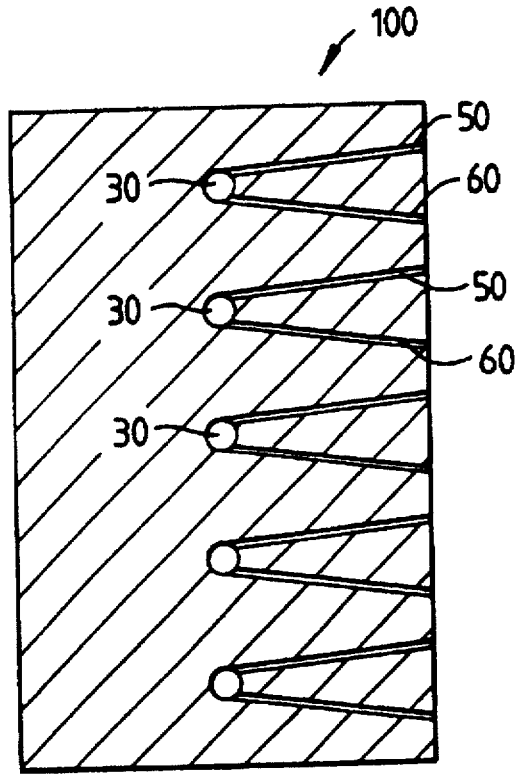
FIG. 3 is a planar sectional view of a second plate.
Figure 4:
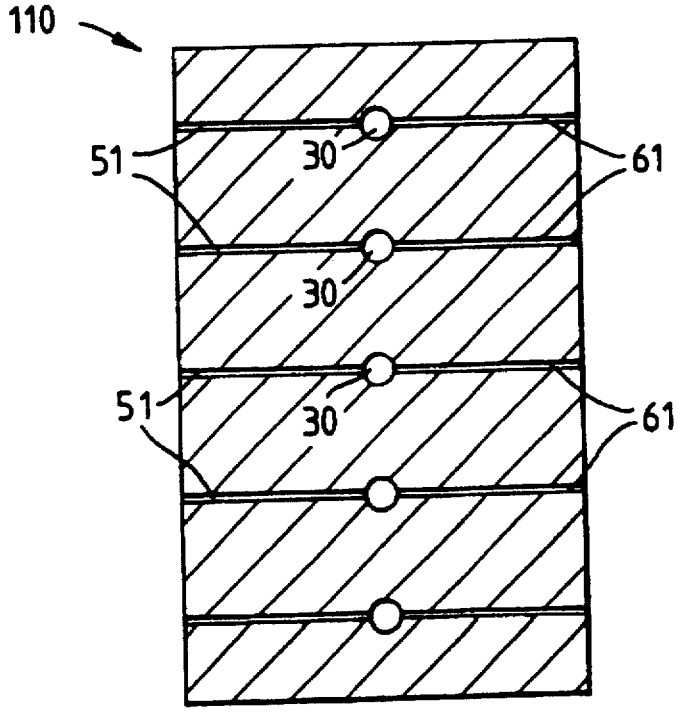
FIG. 4 is a planar sectional view of a third plate.

FIGS. 3 and 4 illustrate respective nozzle plates 100,110 having multiple orifices 30 and cleaning fluid passages 50,60, 51,61 which are arranged as in FIG. 1 (FIG. 2 example) or in alignment across the counterbore (FIG. 3 example).

Cleaning fluid may be supplied from beneath the nozzle through suitable passages formed in the printhead onto which the the plate is attached for use. Suitable seals are provided around the edge of the nozzle plate and individual O-ring type seals may be provided around the inlet and outlet passages 9,10.

We claim:

1. A continuous ink jet printer nozzle plate for an ink jet printer, the nozzle plate including an orifice for emitting a stream of ink; a counterbore surrounding the orifice; and said nozzle plate defining a passage through the plate substantially in the plane of the plate and intersecting the counterbore, through which passage a flow of cleaning agent may be supplied to the counterbore, in order to flush ink from the surrounds of the orifice.

2. A nozzle plate according to claim 1, wherein the passage comprises a supply duct and a return duct through which solvent can be withdrawn from the counterbore area by means of a vacuum pump attached to the return duct.

3. A nozzle plate according to claim 2, wherein the ducts are formed by pairs of channels formed in opposed halves of a composite, two layer, plate.

4. A nozzle plate according to claim 3, wherein the ducts are pairs of V-shaped channels.

5. A nozzle plate according to claim 2, wherein the ducts are formed by wire electro-discharge machining.

6. A nozzle plate according to claim 5, wherein the ducts are pairs of V-shaped channels.

7. A nozzle plate according to claim 2, wherein the ducts are pairs of V-shaped channels.

8. A continuous ink jet printer having a nozzle plate, the nozzle plate including an orifice for emitting a stream of ink; a counterbore surrounding the orifice; and said plate defining a passage between its upper and lower surfaces with the passage being substantially in the plane of the plate and intersecting the counterbore, through which passage a flow of cleaning agent may be supplied through said passage to the counterbore, in order to flush ink from the surrounds of the orifice.

9. The printer according to claim 8, wherein the passage comprises a supply duct and a return duct through which solvent can be withdrawn from the counterbore area by means of a vacuum pump attached to the return duct.

10. The printer according to claim 9, wherein the ducts are formed by pairs of channels formed in opposed halves of a composite, two layer, plate.

11. The printer according to claim 10, wherein the ducts are pairs of V-shaped channels.

12. The printer according to claim 9, wherein the ducts are formed by wire electro-discharge machining.

13. The printer according to claim 12, wherein the ducts are pairs of V-shaped channels.

14. The printer according to claim 9, wherein the ducts are pairs of V-shaped channels.

* * * * *